US006257936B1

(12) United States Patent
Strandberg

(10) Patent No.: US 6,257,936 B1
(45) **Date of Patent: *Jul. 10, 2001**

(54) SET OF DEVICES FOR TRANSFERRING ELECTRIC SIGNALS

(75) Inventor: Lars Strandberg, Västerås (SE)

(73) Assignee: ABB AB, Vasteras (SE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/171,635

(22) PCT Filed: Apr. 16, 1997

(86) PCT No.: PCT/SE97/00635

§ 371 Date: Dec. 4, 1998

§ 102(e) Date: Dec. 4, 1998

(87) PCT Pub. No.: WO97/40549

PCT Pub. Date: Oct. 30, 1997

(30) Foreign Application Priority Data

Apr. 23, 1996 (SE) ..... 9601534

(51) Int. Cl.[7] ..... H01R 9/22
(52) U.S. Cl. ..... 439/715; 439/928
(58) Field of Search ..... 439/928, 709, 439/715, 716

(56) References Cited

U.S. PATENT DOCUMENTS

| | | | | |
|---|---|---|---|---|
| 4,738,632 | * | 4/1988 | Schmidt et al. | 439/341 |
| 5,249,979 | * | 10/1993 | Deinhardt et al. | 439/341 |
| 5,472,347 | * | 12/1995 | Nordenstrom et al. | 439/61 |
| 5,641,313 | * | 6/1997 | Hohorst | 439/709 |
| 5,655,922 | * | 8/1997 | Dux et al. | 439/213 |
| 5,741,142 | * | 4/1998 | Dux et al. | 439/76.1 |

FOREIGN PATENT DOCUMENTS

| | | |
|---|---|---|
| 31 14223 A1 | 2/1982 | (DE) . |
| 0 357 375 A2 | 3/1990 | (EP) . |
| 0 614 248 A2 | 9/1994 | (EP) . |
| 450 534 | 6/1987 | (SE) . |

* cited by examiner

*Primary Examiner*—Brian Sircus
*Assistant Examiner*—Brian S. Webb
(74) *Attorney, Agent, or Firm*—Connolly Bove Lodge & Hutz

(57) ABSTRACT

In a set of devices for transferring electric signals, devices according to at least two different designs are provided. Each device comprises a bus and a connector providing electrical and mechanical connection of the bus to a bus of another of the devices. Each device further includes terminals for external connection of the device to electrical arrangements, for signal exchange with the electrical arrangements. Each device further includes a signal adapting module electrically connected to the bus and to the terminals. The different designs of the devices allow sets of devices to be combined in a way which utilizes space efficiently.

7 Claims, 2 Drawing Sheets

SET OF DEVICES FOR TRANSFERRING ELECTRIC SIGNALS

BACKGROUND OF THE INVENTION

FIELD OF THE INVENTION AND PRIOR ART

The present invention relates to a set of devices for transferring electric signals. Each device comprises a first unit having a bus and means for electrically and mechanically connecting the bus to a bus of another of the devices for connecting the devices to each. Each device further comprises a second unit having terminals for an external connection of the device to electrical arrangements for signal exchange with the electrical arrangements. Each device further comprises a signal adapting module electrically connected to the bus through a connection and to the terminals through a connection, and thereby electrically connecting the bus and the terminals.

Such devices may be of different types and are used for different types of signal transfer, both of numerical and analog character. Signals arriving to the bus of the device, for example from a central unit are after a signal adaptation in the signal adapting module, emitted through a terminal to different electrical arrangements for their control. Signals from the electrical arrangements also pass through signal adaptation in the signal adapting module. For example, analog signals arriving to the bus of the device through the terminals after conversion to numerical signals may be measuring signals from any pressure, temperature or flow sensor. The analog output signal may then be sent to an arrangement for controlling a regulator, for example a valve regulating a flow, or a means regulating the temperature of an oven. Signals arriving to the bus of the device may, in the case of numerical signals, derive from signal contacts or electrical components similar thereto, while signals from the signal adapting module to the terminals may control, for example, a motor through a contactor. The bus may also allow communication between different devices connected to each other and a central unit. The devices or the electrical arrangements connected thereto may also receive their power supply through the bus.

The space requirement for such a device of is strongly dependent upon how many terminals the device has to have. there are devices of two main types which demand much space for connection to a determined number of electrical arrangements.

The first main type is generally called "minimum termination device", and it has substantially the same number of terminals as the number of electrical arrangements to be connected thereto, normally one terminal per signal, plus one or two terminals for power supply, which the arrangements have in common. Such a device may be compact and demands little space, but it has the disadvantage that a number of electrical components have to be arranged outside the device between the latter and the electrical arrangements. Further, an extended arrangement of cables will be necessary, since the electrical arrangements each require two or more terminals. Such electrical components may, for example, be different types of switching means, circuit breakers, components setting conditions, terminals and so on. It is not possible to connect more than a few arrangements, each requiring two or more terminal connections or connection interfaces, to such a device.

Devices according to the second type have more than one terminal for the same number of arrangements as devices according to the first type only have one terminal for, and They may also have electrical components incorporated into the signal path between the signal adapting module and the terminals. This has the advantage that no such electrical components have to be arranged outside between the device and the electrical arrangements, which results in a considerably simpler arrangement of cables. Such a device requires more space than devices of the first type, since it has more terminals, often three terminals per arrangement.

A disadvantage of sets of devices either of the first type or of the second type is being locked into a determined connection interface, which may mean that the connection interface for some devices is unnecessarily large, and the device in question thus requires more space than should be necessary. Or that the connection interface is too small to enable connection of the electrical arrangements desired to a given device in a desired way.

SUMMARY OF THE INVENTION

The object of the present invention is to provide means for considerably reducing the disadvantages mentioned above.

This object, according to the invention is obtained by providing a set which comprises devices according to at least two different designs. The devices of different designs have terminal units with different sizes of spaces provided thereby for terminals, signal adapting components, and bus units having means allowing an optional mechanical connection of the respective bus to a bus of a device of the same or another design. Devices of different designs have members for establishing a connection to similar signal adapting modules.

Thus, through the invention it will be possible to combine devices adapted to exactly the demands of packing density and connection interface required in every special case. It will further be possible to select the connection interface desired for a certain signal adapting module. It will also be possible to combine devices having different connection interfaces to each other while connecting them to the same bus for utilizing space to an optimum. Thus, an optimum adjustment of the demand of space and of different properties may be obtained. However, it is of course possible to only use devices of one and the same design for connection to each other, should this in a given situation be most suitable. The devices having the larger space do not necessarily have a greater number of terminals than those according to the design with the smaller space. The extra space may instead be used, for example for arranging coarser terminals therein, or more signal adapting components therein.

According to a preferred embodiment of the invention the set comprises devices according to a first design having direct electric connection lines of the terminal unit between the signal adapting module and the terminals thereof and devices according to a second design having electrical components arranged on the terminal unit for processing signals deriving from the signal adapting module on their way to the terminals. Compact devices may thus be combined with advanced devices not requiring any external electrical components and complex arrangements of cables.

According to another preferred embodiment of the invention the devices have terminals at a first end thereof, which is opposite to a second end, at which the bus is arranged, and devices according to a design having more terminals than devices according to another design have a larger extension in the longitudinal direction of the bus, i.e. transversally to a line interconnecting the ends, than the design having fewer terminals. Such a design of the devices is advantageous, since devices having a greater number of terminals than other devices will not extend further in the direction away from the bus than the other devices. This will make it possible to arrange a cable channel comparatively closely under the row of devices interconnected.

In a preferred further development of the embodiment having more terminals, devices according to a design having fewer terminals have members for establishing a connection to the signal adapting module adapted to arrange this module with a longer side thereof extending substantially perpendicularly to the direction of interconnection of devices and the extension of the bus. Devices according to the design having more terminals have members for establishing a connection to the signal adapting module adapted to arrange this module with a longer side thereof extending substantially in the direction of the interconnection of adjacent devices and the extension of the bus. Through such a mutual arrangement of terminals and signal adapting modules of the different designs of devices, these may be made very compact for well utilizing the space.

According to a further development of the above described embodiment of the invention the width occupied by the terminals in the direction of the interconnection and the bus extension corresponds substantially to the extension of the signal module in the state in which it is applied on the device of the respective design. "Dead" spaces not utilized are thus avoided.

Further advantages as well as preferred features of the invention appear from the following description and the other dependent claims.

BRIEF DESCRIPTION OF THE DRAWINGS

With reference to the appended drawings, below follows a description of a preferred embodiment of the invention cited as an example.

In the drawings.

DETAILED DESCRIPTION OF PREFERRED EMBODIMENT OF THE INVENTION

Figure 1:
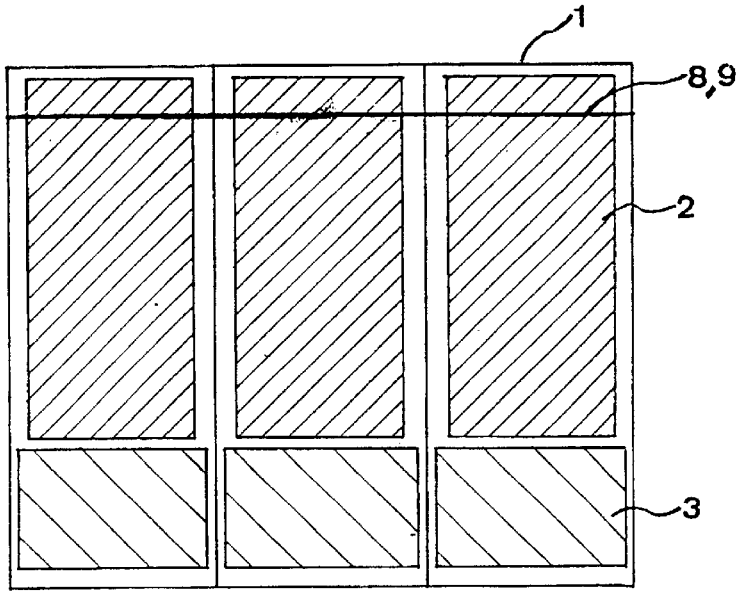
FIGS. 1, 2 and 3 are schematical views illustrating different possibilities for interconnecting devices for transferring electric signals according to a preferred embodiment of the invention.
Figure 2:
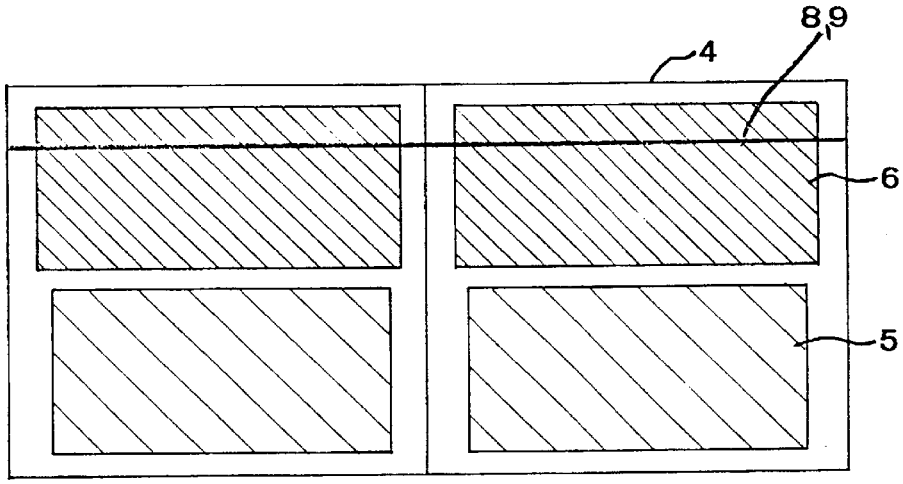
Figure 3:
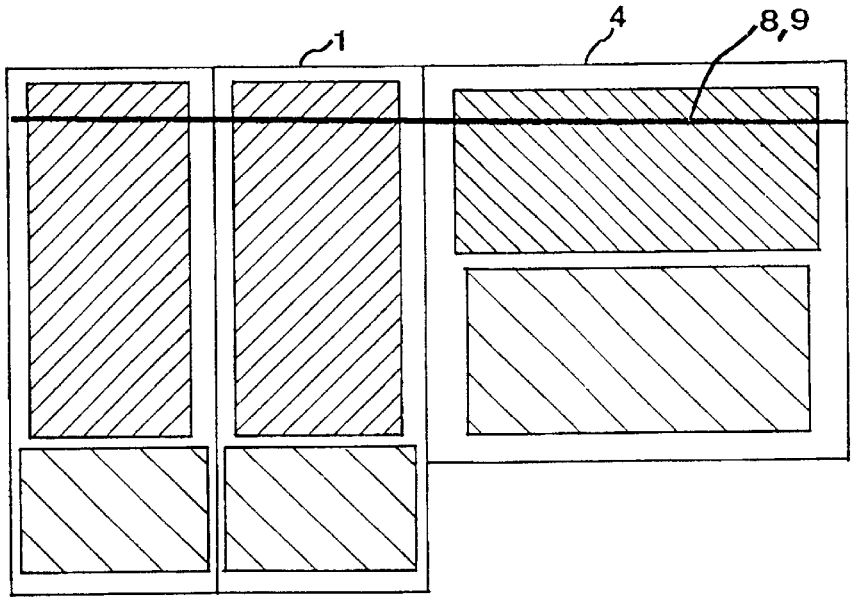

It is illustrated in FIGS. 1–3 how devices of a set of devices for transferring electric signals according to the invention may be connected to each other. The devices each comprise a first unit having a bus, and means for electrical and mechanical interconnection of this bus and a bus of another of the devices, for interconnecting such devices to each other. The devices each further comprise a second unit with terminals for external connection of the device and signal emission to electrical arrangements, and a signal adapting module electrically connected to the bus through a connection and to the terminals through a connection, thereby electrically interconnecting the bus and the terminals. The combinations illustrated are of course only a few of a great number of possible combinations and illustrate that the set has devices according to two different designs, which primarily differ with respect to the number of terminals and which may be optionally connected to each other. More particularly, devices 1 according to a first design have an electronic module 2 indicated through a block comprising a bus unit and a signal adapting module, as well as a terminal unit 3 indicated through another block. The terminal unit of this first design has a small number of terminals, preferably a minimum of terminals for connection of a determined number of electrical arrangements to the device. The electric module 2 is arranged standing on the shorter edge above the terminal unit for obtaining compactness of the device. The devices are connected to each other through a bus 8, 9.

A set according to the invention has also devices 4 according to a second design, which differs from the first design by the fact that the terminal units 5 have a greater number of terminals, so that the terminal units require larger space and have been given a larger extension primarily in the direction of interconnection to adjacent devices. A longest side of the electric module 6 shown has an extension substantially in the direction interconnection.

Figure 4:
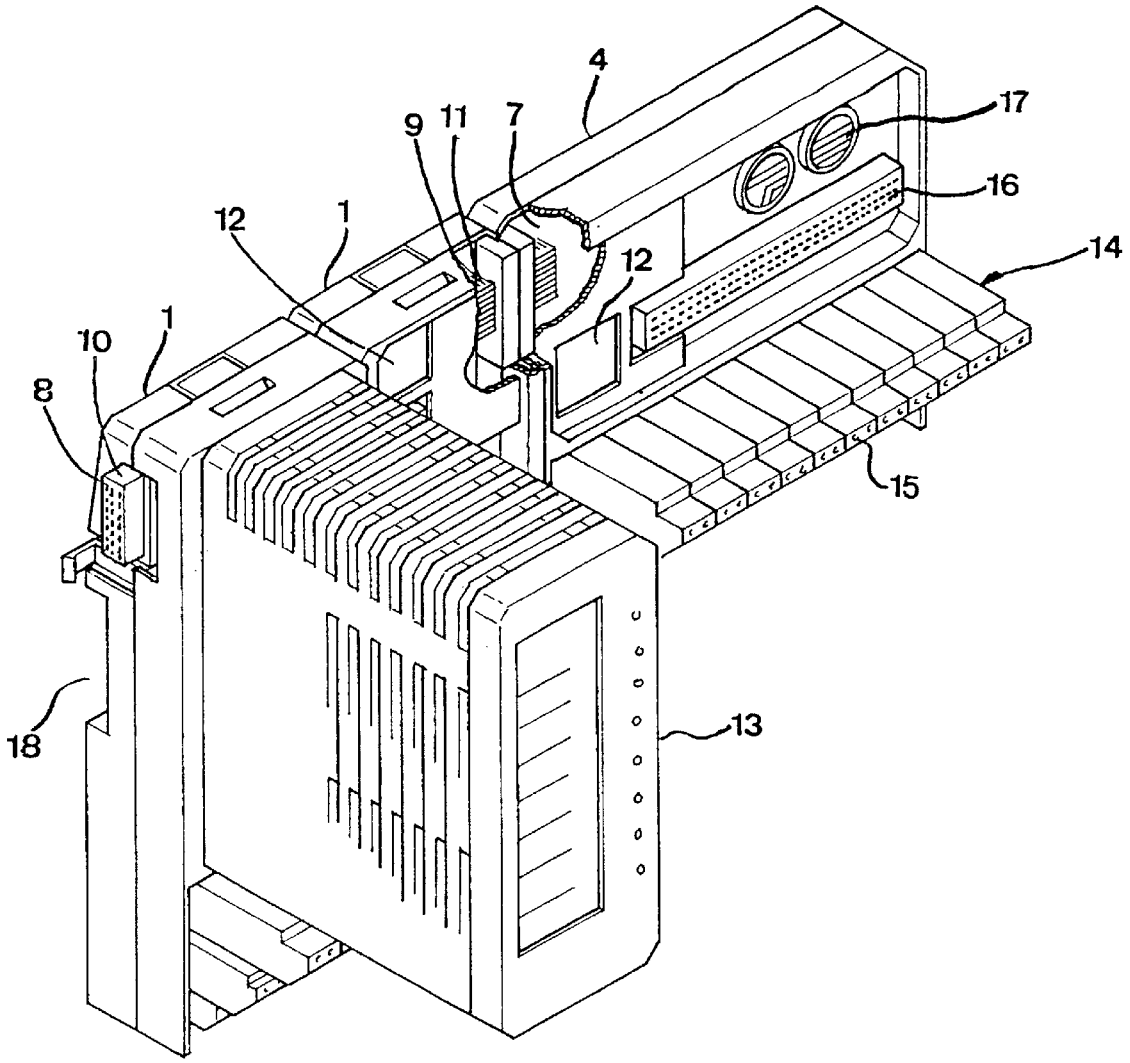
FIG. 4 illustrates in a perspective view how two devices of different designs are designed and may be interconnected, wherein some parts have been taken away or broken away so as to be able to better illustrate the construction of the devices.

The construction of the devices according to the two designs will now be explained more in detail while making reference to FIG. 4. An interconnection of devices for transferring electric signals according to the simplified illustration of FIG. 3 is illustrated in this FIG. 4.

A break-away view is shown for better illustrating the construction of the devices. Each device has a bus unit 7 with a bus connection 8 and a bus connection 9 with means 10, 11 for electrical and mechanical interconnection of the respective bus and a bus of another of the devices for connecting such devices to each other. The bus 8, 9 is arranged on a printed circuit card not shown and included in the bus unit also 7. The bus unit has members, which are indicated by reference number 12, for establishing a connection between the the inlet of a signal adapting module 13, which by one skilled in the art is called an I/O module (input/output module). The signal adapting module 13 is adapted to carry out an adaptation of signals arriving thereto or leaving it between their representation on the bus and at the terminals. It has a bidirectional connection interface towards the bus as well as the terminals mentioned hereinafter. The devices also have a terminal unit 14 with terminals or connection blocks 15 for connecting the device to electrical arrangements. The terminal unit has also members 16 for establishing a connection to a signal connection of a signal adapting module 13. The terminals 15 and the connection member 16 are arranged on a printed circuit card 17 in common, which is indicated through openings in a carrier for the terminal unit. Conduction paths of the printed circuit card connect the member 16 and the terminals 15 electrically to each other. The devices have, on the rear side, a recess 18 for securing to a conventional mounting rail.

The members 16 of the devices in connection with one connection of the signal adapting module may be directly connected to corresponding terminals 15 through conduction paths arranged on the printed circuit card or other electrical components, which have to be cnnected between the signal adapting module and the electrical arrangements intended to be connected to the terminals of the device, and are arranged on the printed circuit card 17 in the path of the signals between the signal adapting module and the terminals. This necessitates a requirement of larger printed circuit card and a larger terminal unit.

Devices 1 according to the first design, have, for a determined number of arrangements connectable thereto, one connection interface, i.e. the terminal per arrangement, while devices 4 according to the second design offer more than one connection interface per arrangement, corresponding to a number thereof, which makes the space demand, i.e. the space demand for the terminals thereof, larger.

Devices of different designs have been designed so that they may be connected to each other while establishing a continuous bus extending therethrough and while providing the possibility to use an identical signal adapting module 13 for devices having different designs, so that for a signal adapting module the connection interface considered to be most appropriate in a given use may be chosen so as to satisfy the need of number of connection interfaces and space in the best possible way.

A device 1 with a minimum amount of terminals has typically one terminal per arrangement to be connected thereto as well as one or two terminals in common for the arrangements for power supply thereof, which may mean 16+1 or 16+2necessary terminals for a 16-channel device, while a device 4 having an advanced terminal unit may typically have several terminals for each arrangement to be connected thereto, which may mean 3×16 terminals. These three may be intended for + and − for supply and for signal.

The invention is of course not in any way restricted to the preferred embodiment described above, but several possibilities to modifications thereof would be apparent to one with skill in the art without departing from the basic idea of the invention.

It is for instance within the scope of the invention to provide a set of devices according to more than two different designs. "Electrically connected" and "electrically connected" in the claims and in the description has not be interpreted as a requirement to have a direct electrical connection established, but the parts in question may be galvanically separated from each other. Thus, such a connection means that electric signals may be transported between the parts.

What is claimed is:

1. An apparatus comprising:

a number of first devices and a number of second devices for transferring electric signals, each of said first and second devices comprising:

a first unit including a first bus, and a device interconnect means for electrically and mechanically connecting said first bus to said first bus in two other of said first and second devices;

a second unit including a number of terminals for external connection to an electrical arrangement, for signal exchange therewith; and a number of signal adapting modules each mechanically connected to only one of said first and second devices and electrically interconnecting said first bus and said terminals, wherein:

each of said second devices has a greater number of said terminals than each of said first devices, and said first and second devices have respective longitudinal axes intersecting substantially perpendicularly when said first and second devices are mechanically connected together.

2. The apparatus according to claim 1, wherein:

said second unit of said first device includes direct electric connection lines connecting said signal adapting module to said terminals; and said second unit of said second device includes electrical components for processing signals received from said signal adapting module and directed to said terminals.

3. The apparatus according to claim 2, wherein:

said second units of said first and second devices include a printed circuit card having conducting paths for electric connection of said signal adapting module to said terminals; and said electrical components are included on said circuit card.

4. The apparatus according to claim 1, wherein the longitudinal length of said second device exceeds the transverse length of said first device by an amount corresponding to an additional space required by an additional number of terminals or other electrical components.

5. The apparatus according to claim 1, wherein a width occupied by said terminals of either of said first or said second devices substantially corresponds to an extension of said signal adapting module when connected to said first device or said second device.

6. The apparatus according to claim 1, wherein said second device has at least twice as many terminals as said first device.

7. The apparatus of claim 1, wherein:

said first and second devices are connected to a predetermined, equal number of electrical arrangements;

said first device being connected to said pre-determined number of electrical arrangements by a single wire connection; and said second device being connected to said predetermined number of electrical arrangements by an n-wire connection, where n is an integer greater than or equal to 2.

* * * * *